United States Patent [19]

Baran et al.

[11] 4,331,852

[45] May 25, 1982

[54] INDUSTRIAL MEMBRANE SWITCH WITH BREATHER

[75] Inventors: Michael S. Baran, St. Francis; Gary C. Fillus, South Milwaukee, both of Wis.; Eric L. Long, Northbrook, Ill.

[73] Assignee: Allen-Bradley Company, Milwaukee, Wis.

[21] Appl. No.: 193,490

[22] Filed: Oct. 3, 1980

[51] Int. Cl.[3] ..... H01H 9/04

[52] U.S. Cl. ..... 200/306; 200/159 B; 200/302

[58] Field of Search ..... 200/159 B, 302, 306, 200/330, 340

[56] References Cited

U.S. PATENT DOCUMENTS

| | | | |
|---|---|---|---|
| 3,643,041 | 2/1972 | Jackson | 200/5 A |
| 3,735,068 | 5/1973 | Yahaga et al. | 200/159 B |
| 4,018,999 | 4/1977 | Robinson et al. | 200/5 A |
| 4,046,975 | 9/1977 | Seeger | 200/159 B |
| 4,046,981 | 9/1977 | Johnson et al. | 200/159 B |

*Primary Examiner*—John W. Shepperd

*Attorney, Agent, or Firm*—Quarles & Brady

[57] ABSTRACT

A push button switch has an operator that is mounted for axial movement within a bezel towards its exit end. A contact assembly is disposed across the exit of the bezel. The contact assembly includes a pair of termination areas formed on a substrate and a shorting patch disposed on a flexible membrane, the shorting patch being separated from the termination areas by a spacer to provide a switch air gap. A second spacer is disposed on the other side of the substrate and forms an air reservoir that communicates with the switch air gap through an aperture in the substrate. When the operator is moved against the membrane to close the switch air gap, air is circulated into the air reservoir increasing the pressure therein, and returns to break the contact of the termination areas with the shorting patch when the operator is retracted.

5 Claims, 4 Drawing Figures

INDUSTRIAL MEMBRANE SWITCH WITH BREATHER

BACKGROUND OF THE INVENTION

1. Field of the Invention

The invention relates to the field of control switches of the type used in control panels and switch stations in an industrial environment.

2. Description of the Prior Art

In the field of digital office equipment, touch-actuated switching panels have been developed to replace traditional key-operated panels. These newer panels commonly involve several thin sheets of an insulating material such as Mylar. A spacing sheet is used between two other sheets on which conductive areas have been formed by screen printing or other deposition processes. The spacing sheet contains openings to allow the conductive areas on the spaced apart sheets to contact one another when pushed together at the touch of an operator. Such pressure sensitive switching panels have their functional labels arranged in patterns and arrays resembling keyboards, yet such panels are flush with the surface of the control panel or equipment utilizing them. Such panels have the advantage of sealed contacts, but in an industrial environment lack the tactility or other form of feedback to the human operator that is provided by traditional industrial controls. Such membraneous, touch sensitive switching panels are by the nature of their construction more readily adapted to arrays and have not provided suitable individual switches that can be located apart from control panels.

In membrane switches of the type described, there is a small amount of air trapped between the conductive areas that meet when one of the membranes is deflected. With this deflection the air pressure is increased, as there is nowhere for the air to escape. To provide better switching action in membrane arrays, channels have been formed in the spacer so that air may be cross-vented from one set of switch contacts to another. There has not been a comparable development of a breather for an individual switch of the type disclosed in the copending application of Long et al filed concurrently herewith and entitled "Industrial Membrane Switch," and for an individual switch of the type disclosed in the copending application of Fillus et al filed concurrently herewith and entitled "Illuminated Industrial Membrane Switch."

SUMMARY OF THE INVENTION

The invention is provided in an electrical switch of the type that combines an operator assembly, having the look and feel desired in the manufacturing environment, with a contact assembly having a thin-layered construction of the general type seen in membrane switches. The invention resides in the features of construction which provide a reservoir in an individual switch to which air from the switch gap can travel when the switch is actuated.

A membrane and substrate with conductive elements are spaced apart to form a switch air gap and are both disposed in a cup that encloses the contact assembly. This cup is mounted on the end of a switch operator of the type described in the copending application of Long et al cited above. The reservoir is formed by the provision of a spacer between the back side of the substrate and an interior wall of the contact cup, the spacer including a central opening that forms the reservoir. The substrate is provided with an aperture communicating with the air reservoir, so that when the membrane is deflected air will be circulated to the reservoir, the air being recirculated back to the switch gap when the operator is released.

It is one object of the invention to improve the operability of an industrial switch having membraneous contacts by reducing the air pressure between conductive surfaces forming the contacts.

It is another object of the invention to provide an alternative to cross-venting between switches, where more than one of the switch units is used in a control panel.

It is another object of the invention to provide a closed, recirculating air system for a sealed control switch.

It is another object of the invention to provide an air reservoir of a particular size relative to the chamber in which the contacts are situated, thereby preventing excessive air pressure in the contact chamber and undesired resistance to operator travel.

The foregoing and other objects and advantages of the invention will appear from the following description. In the description reference is made to the accompanying drawings which form a part hereof, and in which there is shown by way of illustration the embodiment of the invention. Such embodiment does not necessarily represent the full scope of the invention, however, and reference is made to the claims for determining this scope.

DESCRIPTION OF THE PREFERRED EMBODIMENT

Figure 1:
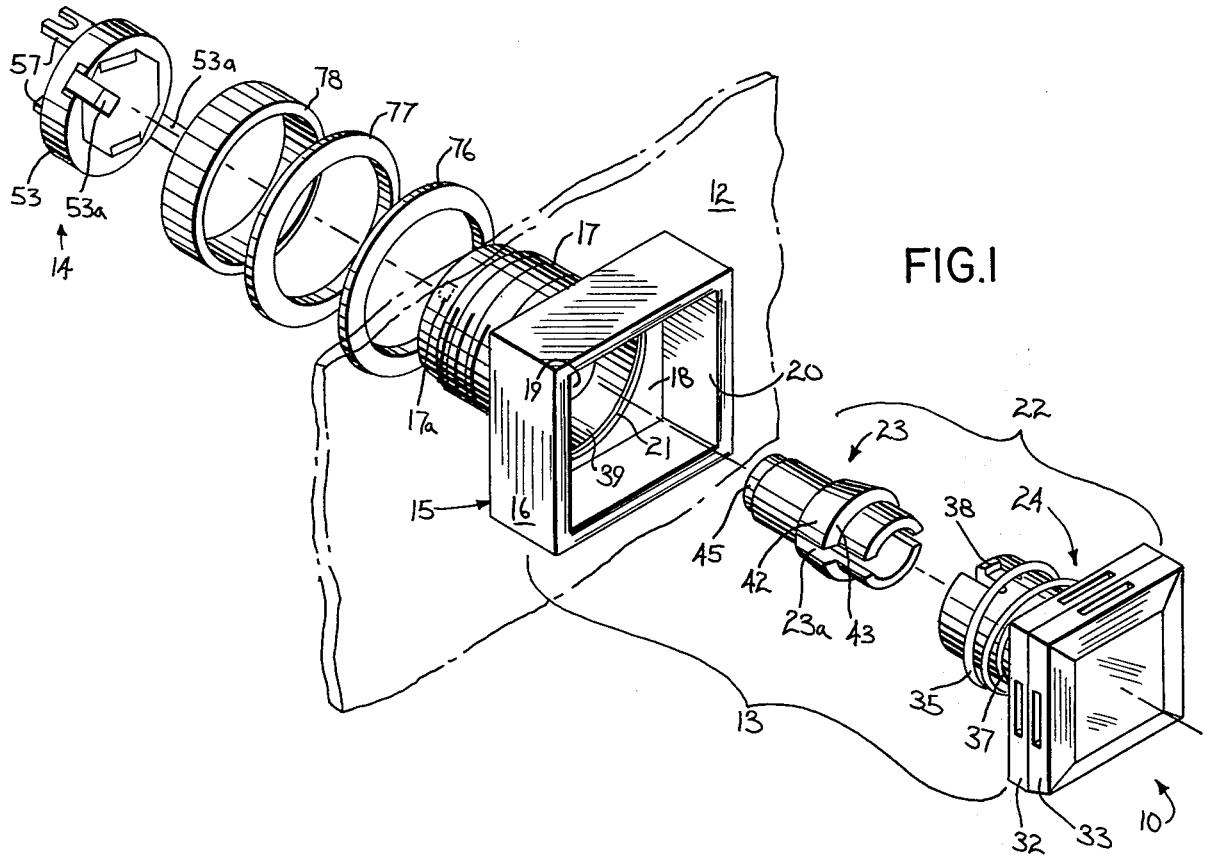
FIG. 1 is an exploded perspective view of a push button switch that embodies the present invention.
Figure 2:
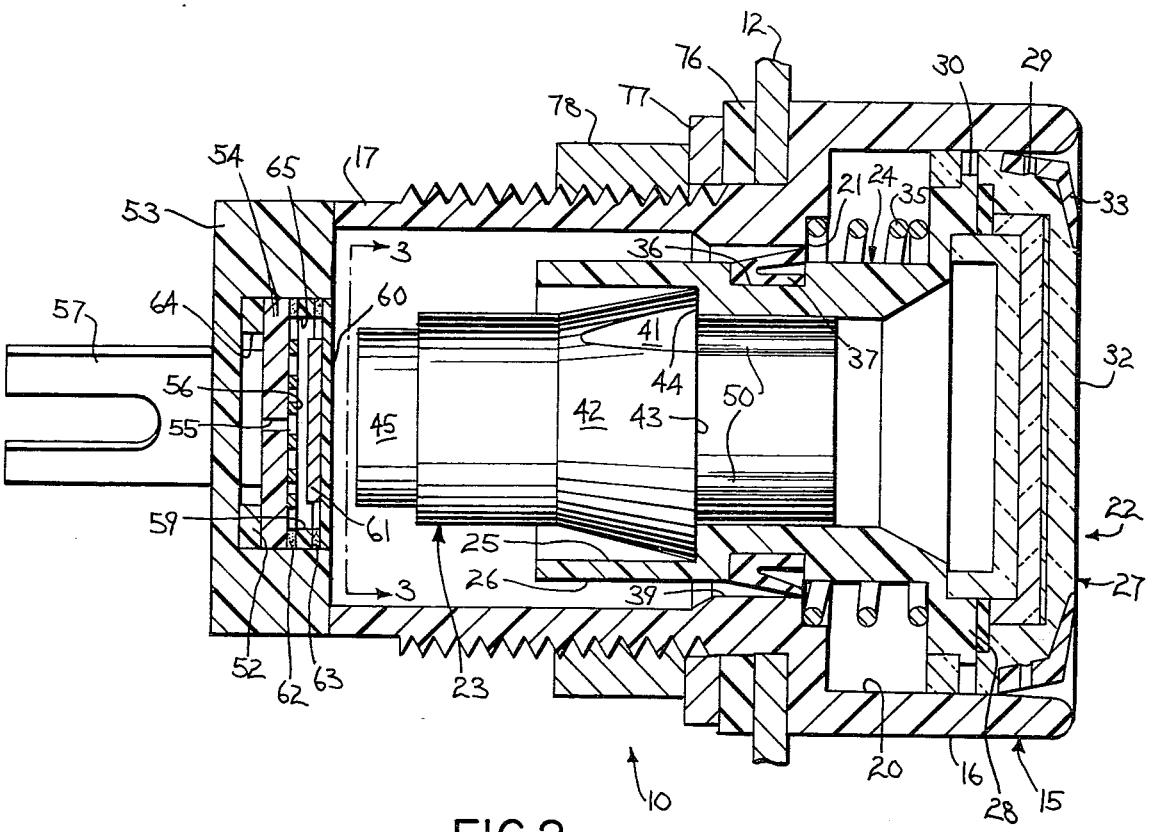
FIG. 2 is a sectional view of the push button switch of FIG. 1, looking vertically downward through a horizontal plane that bisects the switch, with certain interior parts broken away.

Referring to FIGS. 1 and 2, an electrical switch 10 adapted for attachment to a control panel 12 or other supporting structure, includes an operator assembly 13 and a contact assembly 14. The operator assembly 13 is housed in a bezel 15 molded from a thermoplastic insulating material and having a forward box-shaped portion 16 with an entrance into a rectangular opening 20, which is framed by four rounded edge surfaces. A barrel portion 17 of the bezel 15 extends from a rear wall 18 of the rectangular portion 16, the barrel portion 17 having a cylindrical opening 19 that extends from the rectangular opening 20 to a housing exit at the rear end of the bezel 15. An annular spring seat 21 is formed in the rear wall 18 of the rectangular portion 16 around the entrance into the barrel opening 19.

As seen in FIG. 1, an operator 22 includes an elongated, cylindrical plunger 23 which has been removed from a cap assembly 24. Referring to FIG. 2, a plunger-receiving cavity 25 is formed in a hollow, cylindrical cap stem 26 to receive the plunger 23 when the operator 22 is assembled. A complex lens assembly 27 with a plurality of light-transmitting members is mounted on a rectangular flange 28 at the front end of this cap stem 26. The lens assembly 27 forms a head for the operator cap 24 that fills the rectangular opening 20 in the bezel 15 and is flush with the front edges of the bezel 15. The head of the cap 24 could, of course, be positioned rearwardly from the front edges of the bezel 15 to provide a guard for the operator 22. As seen in FIGS. 1 and 2, the lens assembly 27 includes a rectangular lens frame 33 that snap fits over projections 30 formed on the lens 32 and has a rectangular opening in which a portion of the lens 32 is received. The lens 32 in turn snap fits over projections 29 formed on the rectangular flange 28 (as seen in FIG. 2).

When the operator button is assembled in the bezel 15 as seen in FIG. 2, a return spring 35 is captured between the spring seat 21 and the cap stem flange 28. The return spring 35 is compressed when the operator 22 is moved through the opening 19, 20 towards the rear of the bezel 15, and the spring 35 stores energy that exerts a return force on the head of the operator cap 24, when the operator 22 is released by a user. The operator stem 26 has a channel 36 encircling it midway between the stem flange 28 at its forward end and the opening into the plunger cavity 25 at its rear end. A U-cup seal 37 of thin elastomeric material is fitted into this channel, the seal 37 tapering from a wider effective width to a narrower effective width as it extends rearwardly through the barrel opening 19. This seal 37 protects the barrel opening 19 against the intrusion of oil or other contaminants.

Figure 3:
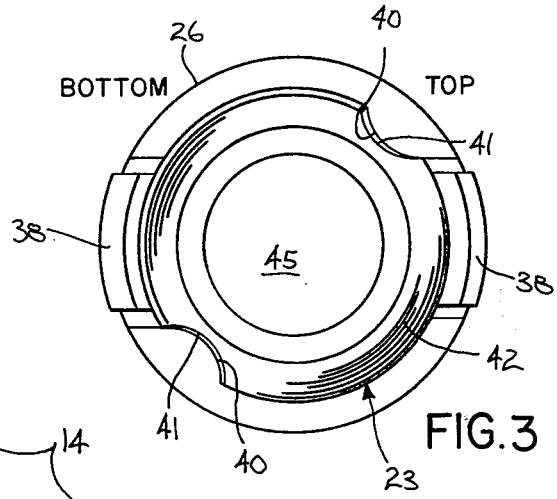
FIG. 3 is a rear end view of the push button operator of FIG. 2, taken in the plane indicated by line 3—3 in FIG. 2.

As seen in FIGS. 1 and 3, the cap stem 26 is formed with two flexible barbed fingers 38, to hold the operator 24 in position within the bezel 15. The barbed fingers 38 are formed by a plurality of slots extending axially into the cap stem 26 from its rear end, the stem 26 being terminated in four segments, two of which form the retaining fingers 38. The barbed ends of these fingers 38 snap over an integrally formed annular retaining ring 39 seen partially in perspective in FIG. 1, and seen in cross section in FIG. 2, where the barrel opening 19 is narrowed at its entrance.

In FIG. 3, two other oppositely disposed segments carry rounded, inwardly extending projections 40 that are radially spaced 180 degrees apart. These projections 40 are received in detents 41 (seen best in FIG. 2) formed in a tapered annular flange 42 seen best in FIG. 1 where it encircles the middle of the plunger 23. The detents 41 are also spaced 180 degrees apart, as seen in FIG. 3, to cooperate in keying the position of the plunger 23 within the stem cavity 25. As seen best in FIG. 1, the beveled flange 42 also forms an annular surface 43 at its forward end, and in FIG. 2 with the plunger 23 inserted in the stem cavity 25, this surface 43 engages an annular stop surface 44 formed in the interior of the cap stem 26. The upper end of the plunger 23 forms ribs 50 that provide an interference fit against the surface defining the upper end of the plunger-receiving cavity 25, to securely hold the plunger 23 against axial displacement relative to the cap stem 26. The plunger 23 is completed by a pad 45 of resilient insulating material which is mounted on its distal end and extends toward the housing exit.

Figure 4:
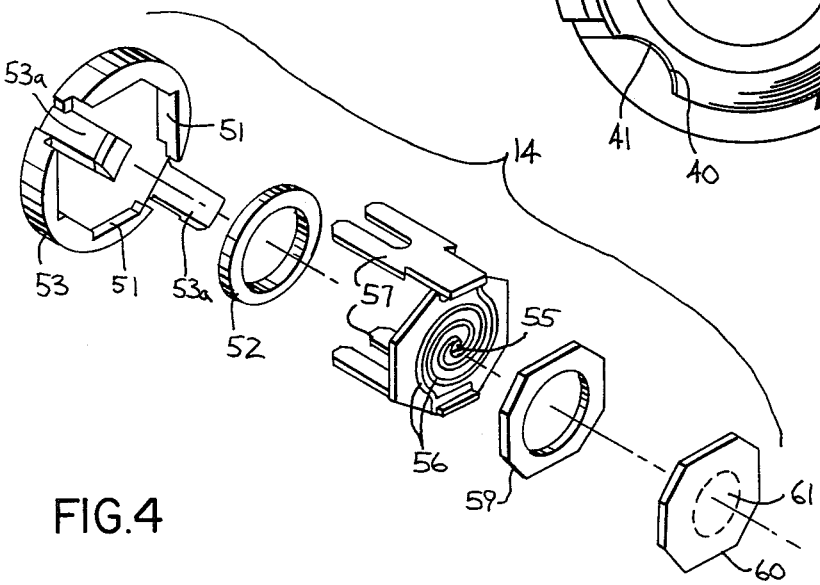
FIG. 4 is a detail exploded view in perspective of a contact assembly that is the upper left component seen in FIG. 1.

Referring to FIG. 4, the contact assembly 14 includes a contact support cup 53 of thermoplastic insulating material with an octagonal cavity that forms eight interior walls. Four rectangular slots 51 are formed in the bottom of the cup and arranged in opposing pairs along orthoganal axes. The slots 51 are each parallel to a respective wall, and these four walls are alternated with four obliquely disposed walls formed around the octagonal cavity. A breather ring 52 of elastomeric material is disposed in the bottom of the cup 53 and an octagonal substrate 54 is disposed over the breather ring 52 as seen in cross section in FIG. 2. The substrate 54 has a centrally located aperture 55 for reasons that are more fully explained below.

Referring again to FIG. 4, two spiralling termination areas 56 are deposited on the front face of the substrate 54, which is made of an insulating glass-epoxy material with electrolytic copper on one side, using an etching technique of a type well known in the art of making printed circuit boards. The etched circuit pattern is then electroplated with small amounts of nickel and gold. The ends of the spiralling termination areas 56 are electrically connected to the upper ends of a pair of primary switch terminals 57 which are anchored near the outside edge of the substrate 54 and which are radially spaced 180 degrees apart. These switch terminals 57 have neck-and-shoulder portions connecting their upper ends to two-legged portions. As seen in FIG. 2, the terminals 57 have their neck portions positioned in the slots 51, where their two-legged portions are twisted about the longitudinal axes of the terminals 57, to anchor them in position in the support cup 53.

Referring to FIGS. 2 and 4, an insulating, octagonal, Mylar spacer 59 with a thickness of five mils is adhesively secured to the front face of the substrate 54 between the outside edges of the spiral configuration and the upper ends of the terminals 57. The spacer 59 has a circular aperture in it for access to the contact termination areas 56. On top of the spacer 59 a flat flexible membrane 60 of insulating material is adhesively secured, the membrane 60 in this instance being an octagonal sheet of Mylar with a thickness of five mils and with a circular shorting patch 61 formed on its back side by screen printing or otherwise depositing a dot of conductive ink or paint thereon. With the membrane 60 in position on the spacer 59, as seen in FIG. 2, the shorting patch 61 opposes the contact termination areas 56 but is spaced apart by a gap of approximately twelve mils occupied by the spacer 59 and two layers 62, 63 of adhesive on opposite sides of the spacer 59. This gap is fully enclosed within a contact chamber 65 formed by the flat stack of assembled layers in FIG. 2. The thicknesses of the layers have been exaggerated in FIG. 2 as an aid in disclosing the invention.

Referring to FIGS. 1 and 4, the contact cup 53 has integrally formed, coupling members 53*a* with barbed ends that are received in a pair of rectangular detents 17*a* formed within the interior of barrel 17, one of the detents being seen in phantom in FIG. 1. The barbs extend radially outward with the coupling members being flexed towards one another as they are forced axially into the exit end of the barrel 17. The result of this arrangement is that the contact cup 53 abuts the exit end of the barrel 17, as seen in FIG. 2, to seal the contact elements 56 and 61 within an insulated switch housing.

The resilient pad 45 is spaced from the exit of the barrel 17, so that it moves through a pre-travel distance before engaging the front side of the membrane 60. The pad 45 is then moved through an additional distance to deflect the membrane 60 and bridge the gap between the spiral contact areas 56 using the shorting patch 61 as the bridging contact element. Besides the measure of pre-travel, several other factors contribute to a sense of feel to the user when the switch 10 is operated. The return spring 35 extends a sufficient distance to provide a measure of over-travel for the switch operator 22, and the resilient pad 45 emulates, to some extent, the action of the user's fingertip. The double spiral configuration of the contact areas 56 eliminates potential blind spots at which deflection of the shorting patch 61 might fail to make a bridging connection; however, this desirable feature is not absolute to the practice of the invention in its broader aspects.

When the membrane 60 is deflected, air is circulated through the aperture 55 in the substrate 54 to an air reservoir 64 provided by the void in the middle of the breather ring 52, and when the operator 22 is released, the air returns to the contact chamber 65 between the substrate 54 and the membrane 60 to break contact. The air reservoir 64 is preferably three times the volume of the contact chamber 65 to allow for a smaller increase in air pressure in the reservoir 64 relative to the drop in air pressure in the contact chamber 65. The 3:1 ratio provides the desired operating characteristics for an individual switch, which are similar to a switch in an array where each switch is cross-vented to three others. The ratio is approximate and may be varied between 2.5:1 and 3.5:1 without exceeding the range where acceptable operating characteristics are provided. To mount the switch operator unit a circular aperture (not seen) is provided in the panel 12, with the switch operator unit 13 being positioned as seen in FIG. 2 with the back side of the rectangular portion 16 of the bezel 15 meeting the front side of the panel. Referring to FIGS. 1 and 3, an annular gasket 76 of a synthetic elastomeric material and a metal washer 77 are slipped over the outside of the barrel 17 and held against the back side of the control panel by an annular lock ring 78 with an interior thread that engages a thread running around the circumference of the barrel 17. The outer surface of the lock ring 78 is knurled for a better grip. It should, therefore, be apparent from this description that a plurality of switches 10 as described herein could be mounted in a single panel 12 to eliminate cross-venting between switches.

While the foregoing description provides the details of making and using this invention, the full scope of embodiments contemplated by the invention is defined by the following claims.

I claim:

1. In an electrical switch having a switch operator housing in which a switch operator with a distal end is disposed for axial movement towards a corresponding, distal end of the operator housing, the combination therewith of a contact unit which comprises:

housing closure means that extends over the distal end of the operator housing, the housing closure means forming a cavity that is sealed within the switch;

a substrate disposed in the cavity of the housing closure means, the substrate having a first contact element disposed on its front side and the substrate having an aperture through it from its front side to its back side;

a pair of switch terminals mounted on the housing closure means, each terminal being electrically connected to a respective termination area;

means in the cavity for supporting the substrate so that its back side is spaced from an interior surface of the housing closure means to form an air reservoir that communicates with the aperture of the substrate;

spacing means disposed over the front side of the substrate and having an opening through which a switch air gap extends; and a flexible membrane closing over the opening in the spacing means and closing off the cavity from the interior portion of the operator housing in which the operator is disposed, the flexible membrane having a second contact element on its back side that is positioned in opposition to the first contact element and separated therefrom by the switch air gap, wherein the membrane is deflected by the actuating movement of the switch operator to urge the second contact element into contact with the first contact element on the substrate while expelling air from the switch air gap to increase the air pressure within the air reservoir, and wherein the membrane is urged by the air pressure from the air reservoir to move back to its position prior to deflection when the switch operator is deactuated.

2. The electrical switch of claim 1, wherein the means supporting the substrate is a ring of elastomeric material.

3. The electrical switch of claim 1, wherein the contact elements are disposed in a contact chamber surrounding the switch air gap, and wherein the ratio of the volume of the air reservoir to the volume of the contact chamber is in a range from 3.5:1 to 2.5:1.

4. The electrical switch of claim 1, wherein the contact elements are disposed in a contact chamber surrounding the switch air gap, and wherein the air reservoir has a volume that is approximately three times greater than the volume of the contact chamber.

5. The electrical switch of claim 1, wherein the substrate, the spacing means and the flexible membrane form a flat stack of assembled layers in which the switch air gap is included within a contact chamber between the flexible membrane and the substrate.

* * * * *